US005297850A

United States Patent [19]

Guleserian

[11] Patent Number: 5,297,850

[45] Date of Patent: Mar. 29, 1994

[54] ORTHOPEDIC LOUNGE CHAIR

[76] Inventor: Armen D. Guleserian, 377 Carolet La., Orange, Calif. 92669

[21] Appl. No.: 898,712

[22] Filed: Aug. 11, 1992

Related U.S. Application Data

[63] Continuation-in-part of Ser. No. 741,035, Aug. 16, 1991, abandoned.

[51] Int. Cl.[5] ..... B60N 2/02

[52] U.S. Cl. ..... 297/377; 297/391; 5/111; 5/656

[58] Field of Search ..... 297/377, 391, 16, 19; 5/431, 435, 111

[56] References Cited

U.S. PATENT DOCUMENTS

| | | | |
|---|---|---|---|
| 3,897,102 | 7/1975 | Lemaire | 5/431 X |
| 3,987,504 | 10/1976 | Fox | 5/111 |
| 4,074,374 | 2/1978 | Ayesh | 5/436 X |
| 4,522,446 | 6/1985 | Sheridan | 297/377 |
| 4,606,086 | 8/1986 | Rowland | 5/431 X |
| 4,891,854 | 1/1990 | Finkelstein | 5/435 |
| 4,941,222 | 7/1990 | Prager | 5/431 X |

*Primary Examiner*—Laurie K. Cranmer
*Attorney, Agent, or Firm*—Lynn & Lynn

[57] ABSTRACT

A lounge chair has a seat section of a selected width connected to a seatback section to provide adjustment of the seatback angle. A person may either sit upright in the chair, or lie on the chair in either the prone or supine positions. A chest support section having a width that is less than the width of the seat section is connected to the seat section so that a person sitting in the chair may place his feet on a surface upon which the lounge chair rests. A person lying face down on the chair may comfortably extend his hands and arms under the chair. An end section extending from the chest support section includes a face passage. A person lying face down on the chair may place his face in the passage and view reading material under the chair. The seat section includes front and rear portions that meet an angle between 158° to 183° to provide an elevated portion that provides a bend to the user's knees when he is sitting upright on the chair with his legs extended and which provides a bend to the user's hips relative to his head when he is lying face down on the chair.

4 Claims, 6 Drawing Sheets

ORTHOPEDIC LOUNGE CHAIR

This is a continuation-in-part of Ser. No. 741,035 filed Aug. 6, 1991 now abandoned.

BACKGROUND OF THE INVENTION

This invention relates to a lounge chair or the like that is designed for a person to sit in or lie in or lie in both the prone and supine positions.

Most conventional lounge chairs are designed to permit the user to lie on his back in the supine position. Such chairs generally have a seatback that can be tilted up so that the user's back is inclined relative to the legs, which extend generally straight out in front of the user's torso. For many people this position becomes uncomfortable after a brief period of time. Typically the user's legs become tired. To sit up straight and read, the user must straddle the seat section of the chair and spread his knees further apart than his shoulders. For most users this wide spread knee position becomes uncomfortable after a brief time because the backs of the legs become tired.

Perhaps the most significant drawback of conventional lounge chairs is the inability to permit a user to lie comfortably on his stomach in the prone position. The user's head must be placed in an awkward position on either the right or left temporal areas of the skull. Within a short period of time in a male user, this position becomes impossible to maintain due to the back and neck muscles debating spasmodic contractions. These contractions make sunbathing for the back side of a person difficult, and it makes reading impossible beyond five to ten minutes for a male. The female anatomy is such that the time for reading in the prone position on a conventional lounge chair may be extended to about fifteen to twenty minutes.

If one lies on his stomach in a conventional lounge chair and attempts to read, he may support the book somehow and arch his back up and lean on his elbows to keep his eyes an acceptable distance from the book. The user may alternatively place the book on the surface that supports the chair and extend his head over the end of the chair. This person must somehow support the weight of his head; and therefore, this position also becomes uncomfortable after a brief period of time.

SUMMARY OF THE INVENTION

A lounge chair or the like according to the present invention has a seat section of a selected width and a seatback section mounted to the seat section. The seat section and seatback section are connected to provide adjustment of the angle therebetween so that a user may either sit upright in the chair or lie on the chair in either the prone or supine positions.

The lounge chair according to the invention includes a chest support section connected to the seat section. The chest support section is notched so that it has a width less than the width of the seat section so that a person sitting in the lounge chair may place his feet on a surface upon which the lounge chair sits, and a person lying face down on the lounge chair may comfortably extend his arms and hands under the chair to reach a book or the like under the chair. The end section preferably includes means for providing a footrest upon which the user may place his feet when he is sitting on the seat section.

The lounge chair according to the invention includes an end section connected to the chest support section. The end section includes a face passage therethrough so that a user lying face down on the lounge chair may place his face in the passage. The end section further includes a head support arranged so that the user's head is comfortably supported with is face in the passage. The end section and the chest support section are arranged such that the user has visual and manual access to reading material or the like placed under the face passage.

The seat section includes front and rear portions that meet an angle to provide an elevated portion that provides a bend to the user's knees when he is sitting upright on the chair with his legs extended and which provides a bend to the user's hips relative to his head when he is lying face down on the chair.

DESCRIPTION OF THE PREFERRED EMBODIMENT

Figure 1:
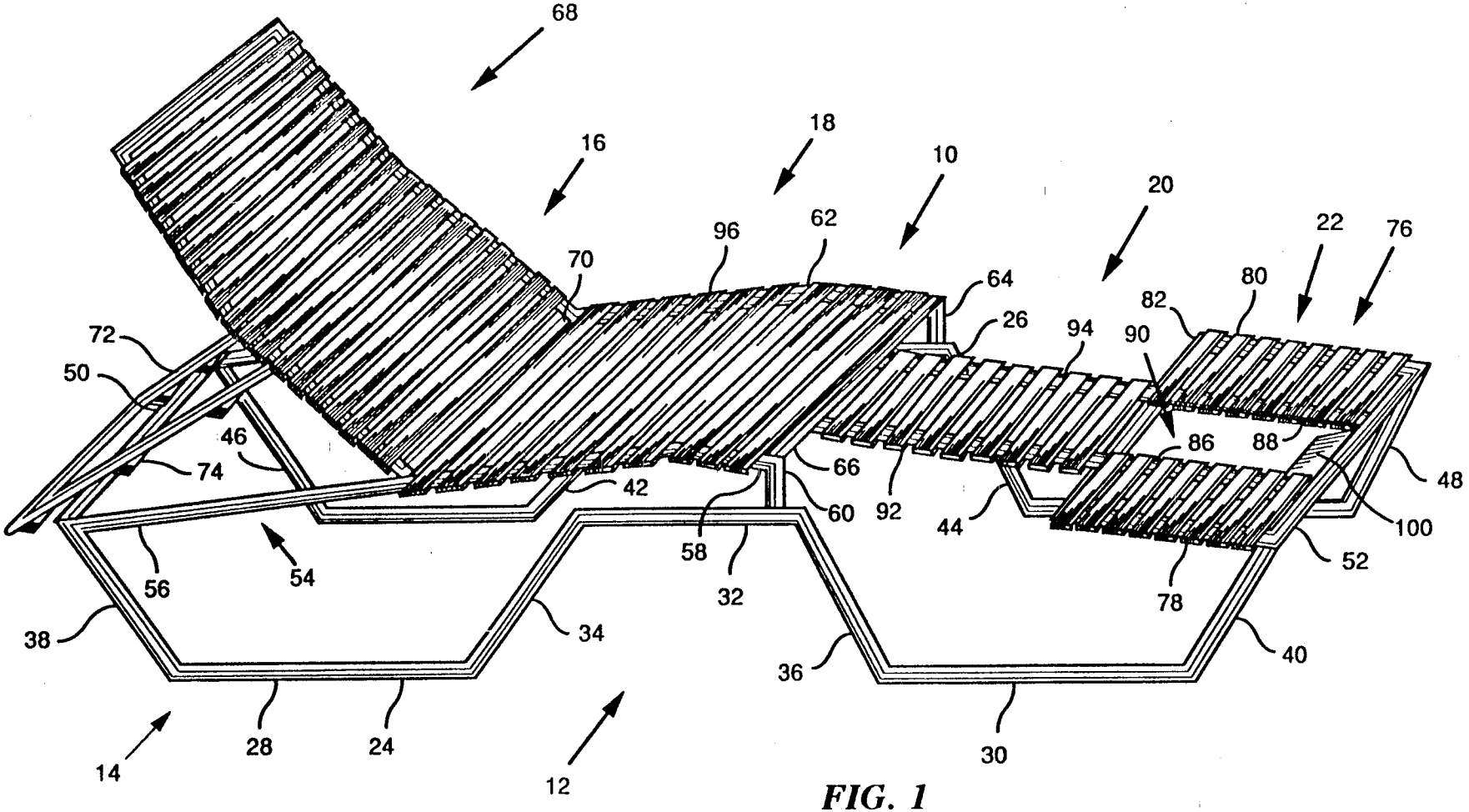
FIG. 1 is perspective view of an orthopedic lounge chair according to the present invention.

FIG. 1 illustrates an orthopedic lounge chair 10 according to the present invention. The orthopedic lounge chair 10 includes a frame 12 that has a support section 14, a seatback section 16, a seat section 18, chest support section 20 and an end section 22. The frame 12 may be formed of any metal tubing or plastic material that has sufficient strength to support the weight of a person using the chair.

Figure 2:
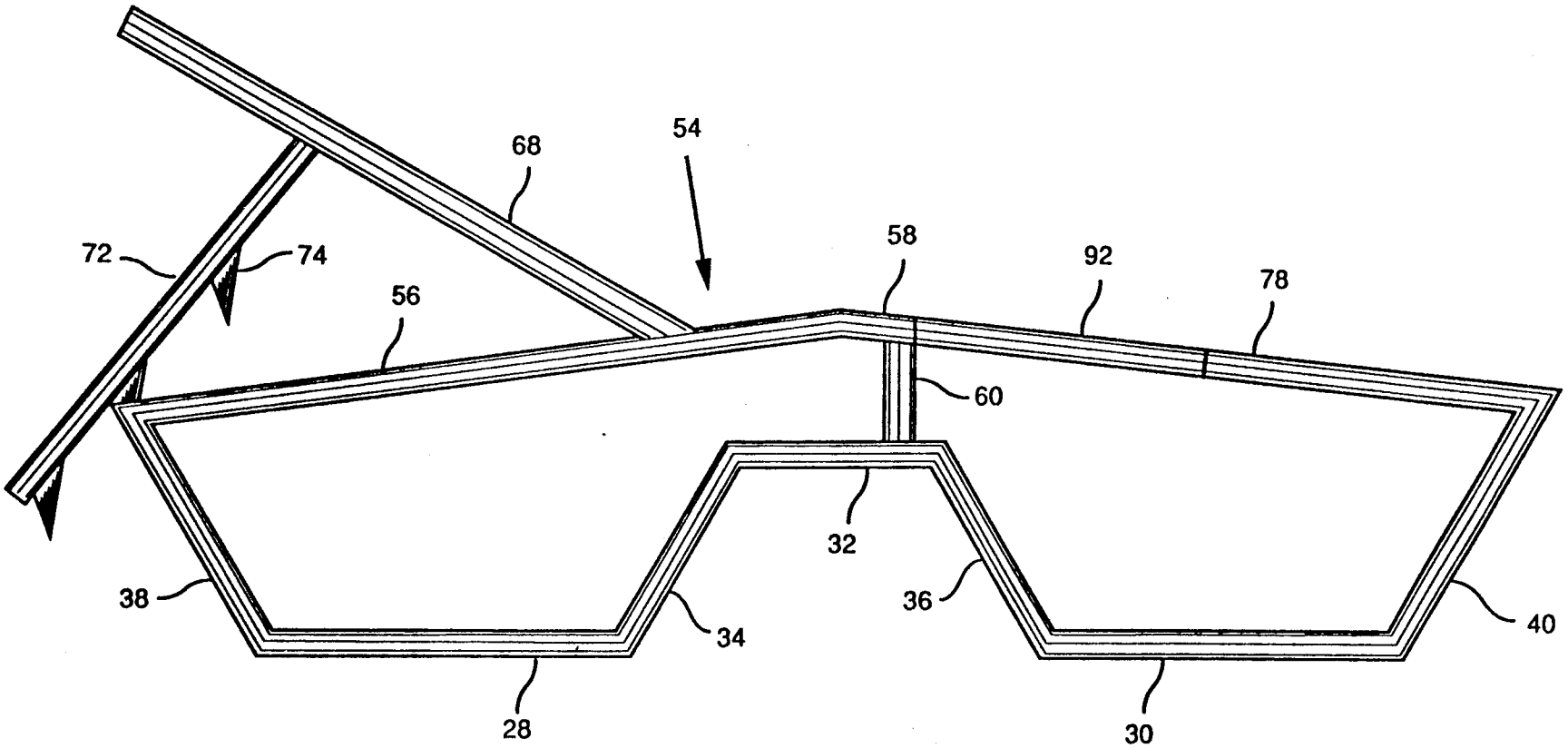
FIG. 2 is an elevation view showing a portion of the frame of the orthopedic lounge chair of FIG. 1 showing the seatback arranged to permit a user to lie on the orthopedic lounge chair in the prone position.

The support section 14 may include a pair of support members 24 and 26 that may be substantially identical. Referring to FIGS. 1 and 2, the support member 24 may include a pair of support rails 28 and 30 that rest upon the ground, a pool deck or the like when the orthopedic lounge chair 10 is in use. Between the rails 28 and 30, the support member 24 may have a raised center section 32 that is connected to the seat section 16. The support member 24 includes a pair of struts 34 and 36 that extend between the ends of the raised center section 32 and the inner ends of the rails 28 and 30. A strut 38 extends from the outer end of the rail 28 to the seat support section 18, and a similar strut 40 extends from the outer end of the rail 30 to the end section 22. The support member 26 includes struts 42, 44, 46 and 48 that correspond to the struts 34, 36, 38 and 40.

A connecting rod 50 is secured between the support members 24 and 26 behind the seatback section. The connecting rod 50 preferably extends between the upper ends of the struts 38 and 46. A second connecting rod 52 is connected between the support members 24 and 26 in the end section 22. The connecting rod 52 preferably extends between the upper ends of the struts 40 and 48.

The seat support section 18 preferably includes a bar 54 that extends from the junction of the connecting rod 50 and the strut 38 to the raised center section 32 of the support member 24. The bar 54 preferably includes a rear section 56 and a front section 58 that meet near the center of the length of the frame 12. The seat support section 18 has a bar 62 that is preferably formed to be identical to the bar 54. The bar 62 is mounted to the support member 26 so that the bars 54 and 62 are parallel.

Referring to FIGS. 1 and 2, the long axes of the rear section 56 and the front section 58 of the bar 54 preferably make an angle of 165° to 166° relative to one another. The angle may be between 158° and 173°. One purpose of the angle between the rear section 56 and the front section 58 of the bar 54 is to provide a slight bend to the user's legs when he is sitting upright in the orthopedic lounge chair 10. When the user is lying face down in the orthopedic lounge chair 10, the angle provides a slight elevation of the user's hips, which is essential for long term comfort in this position. Thus, the angle in the bar 54 contributes to the comfort of the user in either the sitting or prone positions.

The bar 54 may also include a generally vertical section 60. The lower end of the vertical section 60 is connected to the center section 32. The bar 62 may have a vertical section 64 that is substantially identical to the vertical section 60. A horizontal tube 66 is connected between the upper ends of the vertical sections 60 and 64. The vertical sections 60 and 64 of the bars 54 and 62, respectively, and the horizontal bar 66 contribute to the rigidity and structural integrity of the frame 12.

The seatback section 16 includes a generally rectangular frame 68 that may be formed of metal tubing or other material of similar weight and strength. The frame 68 preferably includes a lower bar 70 that is pivotally mounted between the seat support bars 54 and 62. The pivotal mounting of the lower bar permits adjustment of the angle of the seat back section 16 relative to the seat support section. A seatback support section 72 is mounted to the seatback section 16. The seatback support section includes stops 74 that engage the connecting rod 50 to retain the seatback section 16 at a selected position. Although the seatback section 16 has been described with reference to a plurality of bars, it is preferably formed of a single length of tubing or molded as a unitary piece of plastic or the like.

Figure 3:
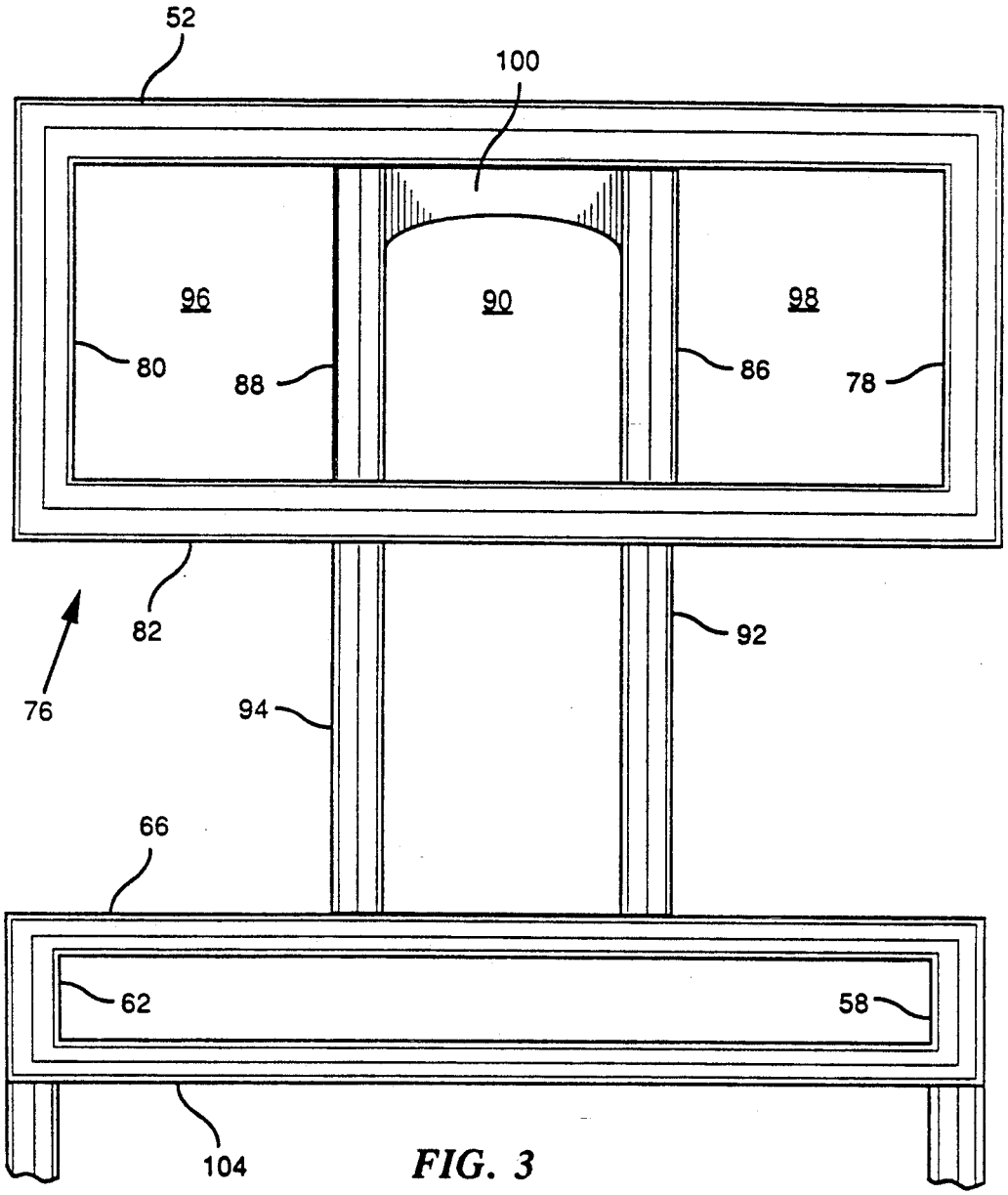
FIG. 3 is a plan view showing chest support and end sections of the frame of the orthopedic lounge chair of FIGS. 2 and 3.

FIG. 3 illustrates the chest and end sections of the frame 12. Referring to FIGS. 1 and 3, the end section 22 includes a generally rectangular peripheral frame 76 that may be formed of metal tubing or the like. The connecting rod 52 forms the front portion of the frame 76. A pair of tubes 78 and 80 extend from the connecting rod 52 toward the tube 66 generally parallel to the front section 58 of the tube 56. A horizontal tube 82 extends between the ends of the tubes 78 and 80. The tube 82 preferably is parallel to and spaced apart from the connecting tube 52. The frame 76 also preferably includes a second pair of tubes 86 and 88 that extend between the connecting tube 52 and the tube 82. The tubes 52, 82, 86 and 88 define a generally rectangular face opening 90.

Referring to FIGS. 1 and 3, the chest support section 20 may be formed to include a pair of generally parallel bars 92 and 94 that extend between the bars 66 and 82. The spacing between the bars 92 and 94 is less than the spacing between the bars 60 and 64 and less than the spacing between the bars 78 and 80. The spacing between the bars 92 and 94 and the bars 76 and 78 may be approximately equal. The bars 66, 82, 92 and 94 define the boundaries of the chest support section 20.

The seatback frame 68, the seat support section 18, and the chest support section 20 are covered with a suitable material such as plastic strips 96, fabric, wooden slats or the like. As shown in FIG. 3, the bars 52, 76, 78, 82, 86 and 88 define generally rectangular sections 90, 96 and 98. The rectangular sections 96 and 98 are preferably covered with a material similar to that used to cover the seat, seatback and chest support sections. The rectangular section 90 is left uncovered to provide a face passage.

Figure 5:
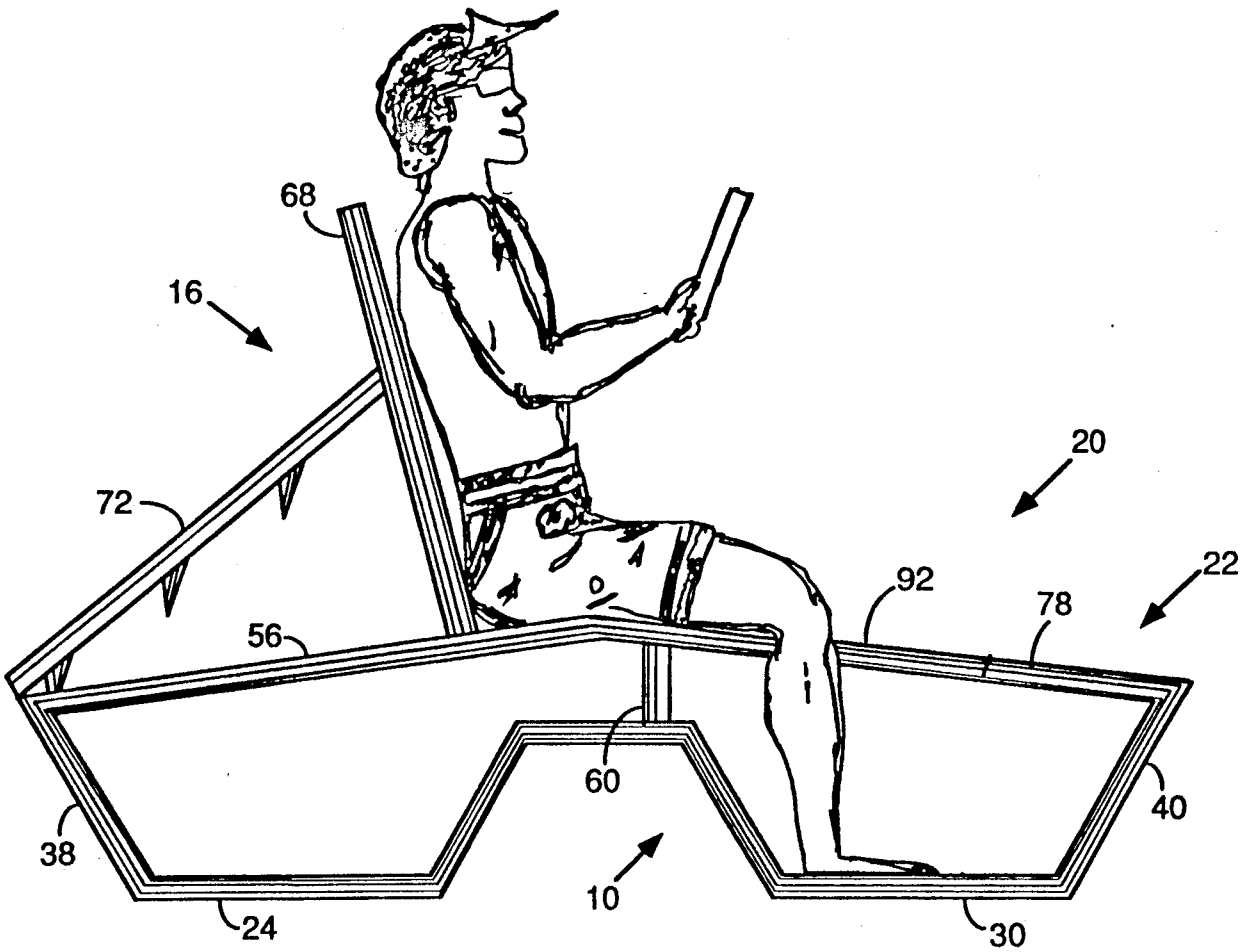
FIG. 5 illustrates a person sitting in a chair according to the invention with his feet on the surface that supports the chair.
Figure 6:
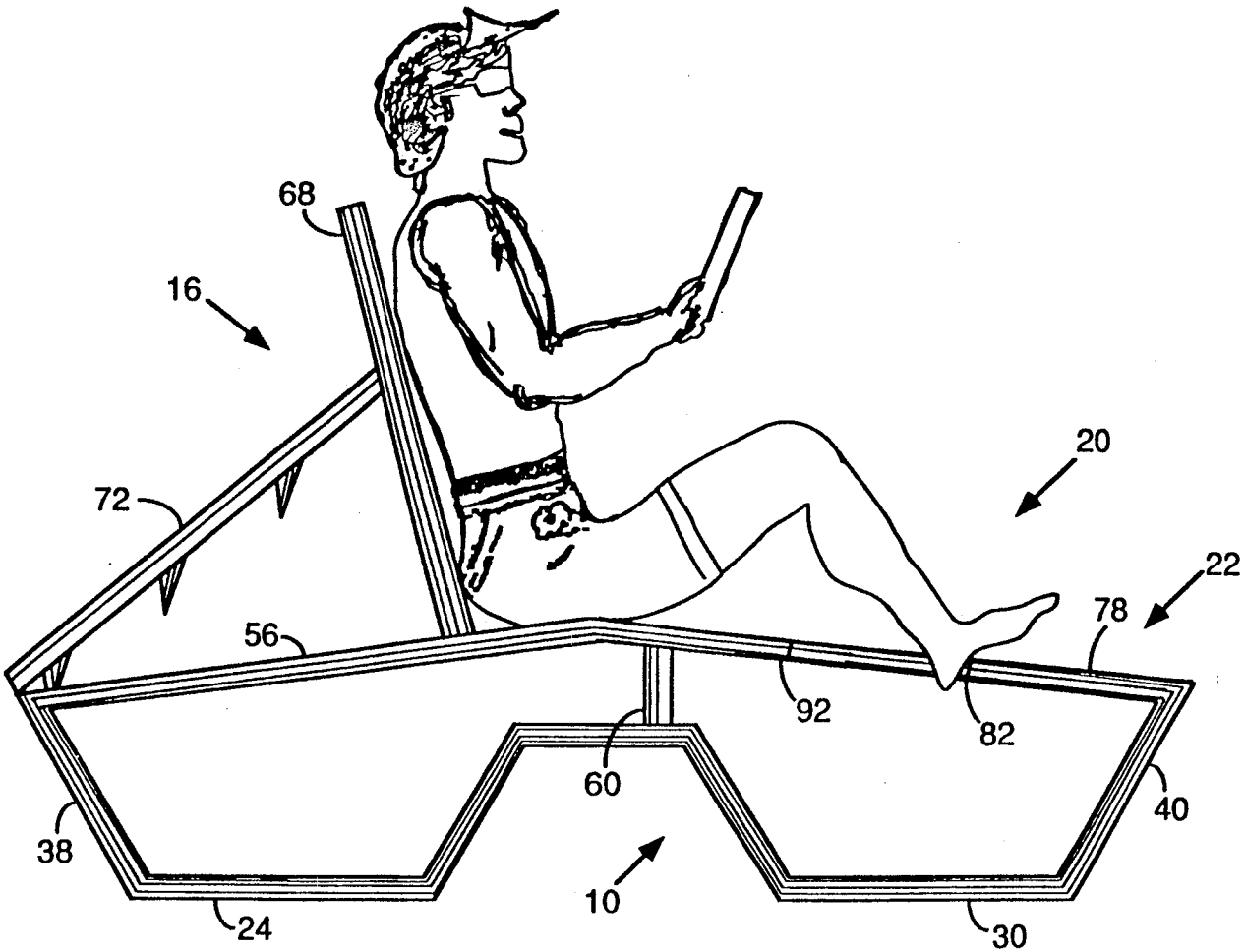
FIG. 6 illustrates person sitting in a chair according to the invention with his feet on a bar in the frame that forms foot rest.
Figure 7:
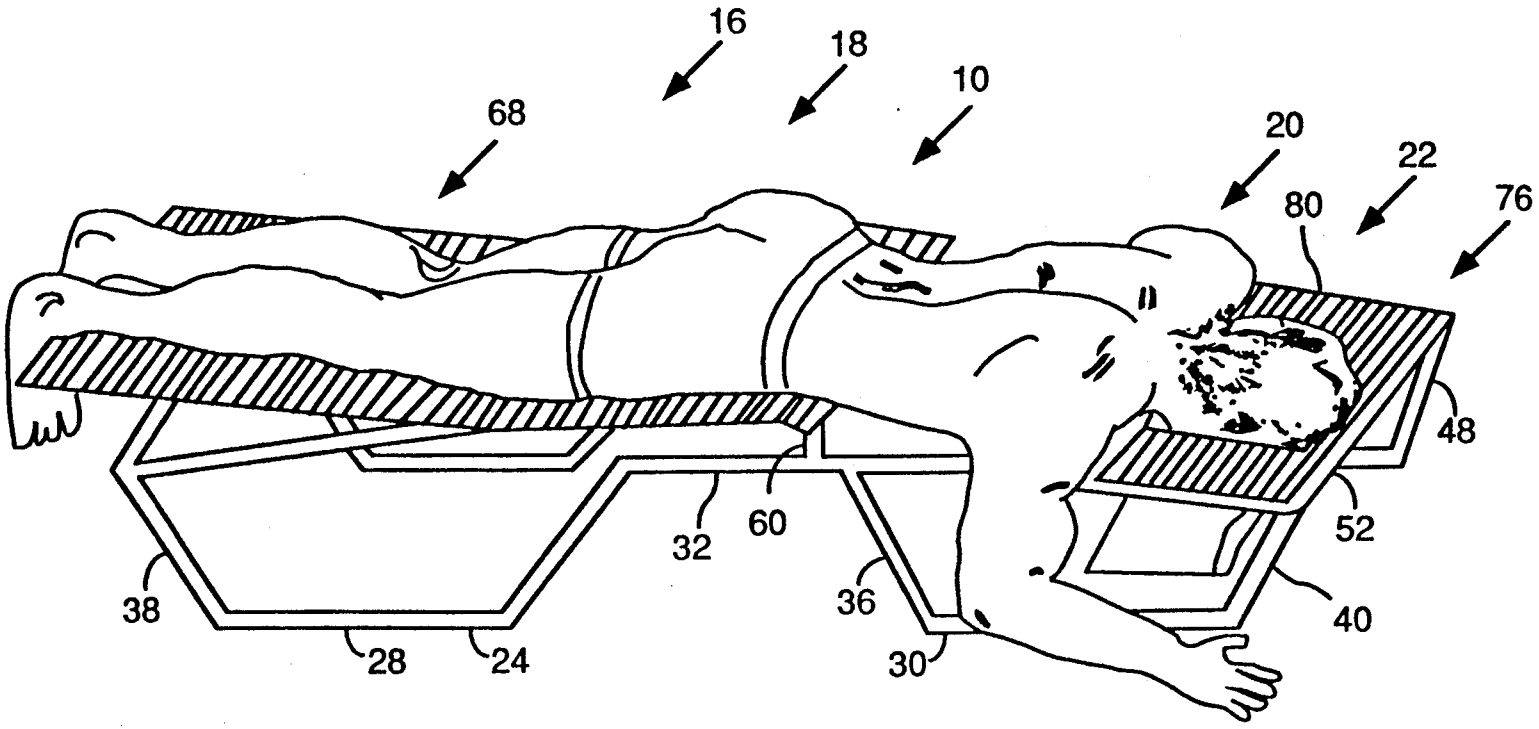
FIG. 7 illustrates a person lying in a prone position on a chair according to the invention with his face extending through an opening in the chair covering and frame so that the person may see a book or the like placed under the chair.

The seat section 18 and seatback section 16 are connected to provide adjustment of the angle therebetween so that a user may either sit upright in the chair 10 as shown in FIG. 5 or lie on the chair 10 in either the prone or supine positions as shown in FIGS. 6 and 7, respectively.

Referring to FIGS. 1 and 5, the chest support section 20 is notched so that it has a width less than the width of the seat section 18 so that a person sitting in the lounge chair may place his feet on a surface upon which the lounge chair 10 sits. The bar 82 provides a footrest upon which the user may place his feet when he is sitting on the seat section 18. A person lying face down on the lounge chair 10 may comfortably extend his arms and hands under the chair 10 to reach a book or the like under the chair 10.

Figure 4:
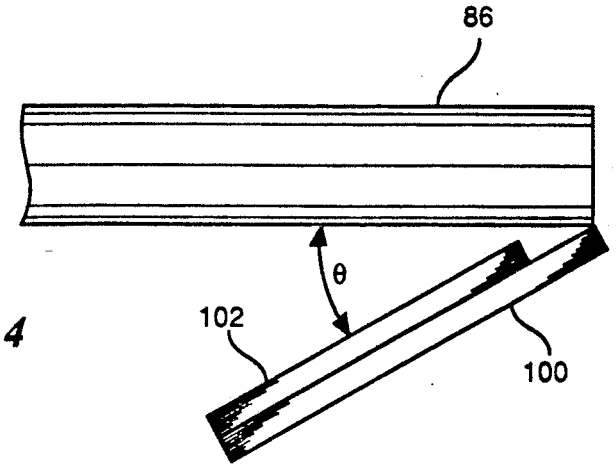
FIG. 4 is a side elevation view showing a head support that may be included in the orthopedic lounge chair of FIGS. 1-3.

Referring to FIGS. 1 and 3–4, a head support 100 is preferably attached to the bar 52. The head support 100 may be formed of a thin sheet of plastic, rubber or the like and, as best shown in FIG. 4, preferably is attached to the frame 12 to make an angle $\theta$ of between 20° and 60° degrees. In a preferred embodiment of the invention, the angle $\theta$ is about 40°. When lying face down on the chair 10, the user may place his face in the face opening 90 and rest his forehead on the head support 100. The head support 100 may be padded or formed to include a soft upper surface 102 as shown in FIG. 4 to provide a soft surface for the user to rest his forehead.

The structures and methods disclosed herein illustrate the principles of the present invention. In particular, it should be noted that the drawings are not to scale and are intended only to illustrate the basic nature of the invention. The structural components of the orthopedic lounge chair 10 are in many cases illustrated as joining at sharp angles. Some components of the orthopedic lounge chair 10 are shown as having sharp bends therein. The corners, joints and bent portions of the frame 12 may be preferably formed to be rounded.

The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. A lounge chair or the like having frame that includes a seat section of a selected width and a seatback section mounted to the seat section to provide adjustment of the angle therebetween so that a user may either sit upright in the chair or lie on the chair in either the prone or supine positions, comprising:

a chest support section connected to the seat section, the chest support section including a pair of generally parallel frame members spaced apart such that the chest support section has a width that is less than the width of the seat section so that a user sitting in the lounge chair may place his feet on a surface upon which the lounge chair sits, and a user lying face down on the lounge chair may extend his arms around the pair of generally parallel frame members of the chest support section so that the user's hands extend under the chair;

an end section connected to the chest support section such that the chest support section is between the end section and the seat section, the end section including extensions of the pair of generally parallel frame members and a pair of crossbars connected perpendicular to the extensions of the pair of generally parallel frame members and spaced apart to define a rectangular face opening therethrough so that a user lying face down on the lounge chair may place his face through the face opening, the end section and the chest support sections being arranged such that the user has manual access to reading material or the like placed under the face opening; and the chest support section having a width less than the width of the end section so that one of the crossbars is adjacent the chest support section, the crossbar having a pair of end portions that extend beyond the width of the chest support section to form a foot rest so that the user may sit in the chair and place his feet on the foot rest.

2. The lounge chair of claim 1 wherein the frame is formed of metal tubing.

3. The lounge chair of claim 1 further including a forehead support connected to the crossbar in the end section distal from the chest support section to support the user's head in a comfortable position when the user's face is in the face passage.

4. A frame for a lounge chair or the like having a seat section of a selected width and a seatback section mounted to the seat section to provide adjustment of the angle therebetween so that a user may either sit upright in the chair or lie on the chair in either the prone or supine positions, comprising:

a chest support section formed to include a pair of generally parallel frame members connected to the seat section, the pair of generally parallel frame members being spaced apart such that the chest support section has a width that is less than the width of the seat section so that a user sitting in the lounge chair may place his feet on a surface upon which the lounge chair sits, and a user lying face down on the lounge chair may extend his arms around the pair of generally parallel frame members of the chest support section so that the user's hands extend under the chair;

an end section connected to the chest support section such that the chest support section is between the end section and the seat section; and the end section including a crossbar connected to an end of the chest support section distal from the seat section, the chest support section having a width less than the length of the crossbar so that end portions of the crossbar form foot rests so that the user may sit in the chair and place his feet on the foot rest.

* * * * *